United States Patent [19]

Litaker

[11] Patent Number: 4,567,074

[45] Date of Patent: Jan. 28, 1986

[54] INSULATING TRAP DOOR COVER

[76] Inventor: Stephen H. Litaker, 5407 Autumn End Cir., Charlotte, N.C. 28212

[21] Appl. No.: 714,476

[22] Filed: Mar. 21, 1985

[51] Int. Cl.[4] ..... B32B 1/04; B32B 3/02; A62B 3/00; E06C 7/00

[52] U.S. Cl. ..... 428/71; 182/46; 182/47; 182/77; 428/81; 428/157; 428/318.4

[58] Field of Search ..... 182/46, 47, 77; 428/68, 428/71, 76, 81, 157, 314.4, 314.8, 318.4

[56] References Cited

U.S. PATENT DOCUMENTS

| | | | |
|---|---|---|---|
| 3,731,443 | 5/1973 | Zaroor | 428/318.4 |
| 3,959,050 | 5/1975 | Hooper, Jr. | 428/318.4 |
| 4,061,807 | 12/1977 | Shaler et al. | 428/314.4 |

*Primary Examiner*—William J. Van Balen

[57] ABSTRACT

A trap door cover consists of a generally rectangular frame. Molding strips are connected to the peripheries of the frame such that the finished frame resembles a picture frame. A slab of insulating material fits inside the frame. The door cover may be attached to the door by two spaced long screws through the insulating slab.

5 Claims, 6 Drawing Figures

INSULATING TRAP DOOR COVER

BACKGROUND OF THE INVENTION

1. Field of the Invention

This invention relates generally to an insulating cover for trap doors where unwanted heat transfer takes place. More specifically, a cover of light weight and simple in construction is removably attached over said trap door.

2. Description of Prior Art

Folding attic stairways with trap doors, access openings to attics and openings for attic fans are sources of heat losses. Much effort has been devoted to the development of insulation devices for prevention of such heat losses. As exemplified in U.S. Pat. Nos. 4,151,894, 4,281,743 and 4,312,423, insulating box-like covers are superimposed on the door frames from above, so as to form an enclosed air space between the cover and the door. Since such covers are installed in attics, they are not visible from the living quarters of homes. Covers of this type require precise cutting and fabrication. Special construction is needed when an attic fan is disposed behind the trap door and the object of the present invention is to provide a simply constructed and easily installed insulating cover for any type of trap door.

SUMMARY OF THE INVENTION

In accordance with the present invention, a trap door cover comprises a slab of rigid insulating material, preferably light in weight of generally rectangular shape, commensurate with the size of the door to be covered.

A rectangular frame, preferably wooden, is formed by four side walls, said side walls have a lower face and the inside dimensions of the frame are the same as the outside dimensions of the slab. Molding strips, optionally with beveled edges and mitered corners are rigidly connected to the lower face of the side walls forming a lip extending inwardly in a manner such that the slab is affixed onto the lip. The resulting structure resembles a picture frame. The slab is adhesively affixed onto the lip and optionally to the sidewalls of the frame.

The insulating cover is removably attached to the door by spaced wood screws.

DESCRIPTION OF PREFERRED EMBODIMENT

Figure 1:
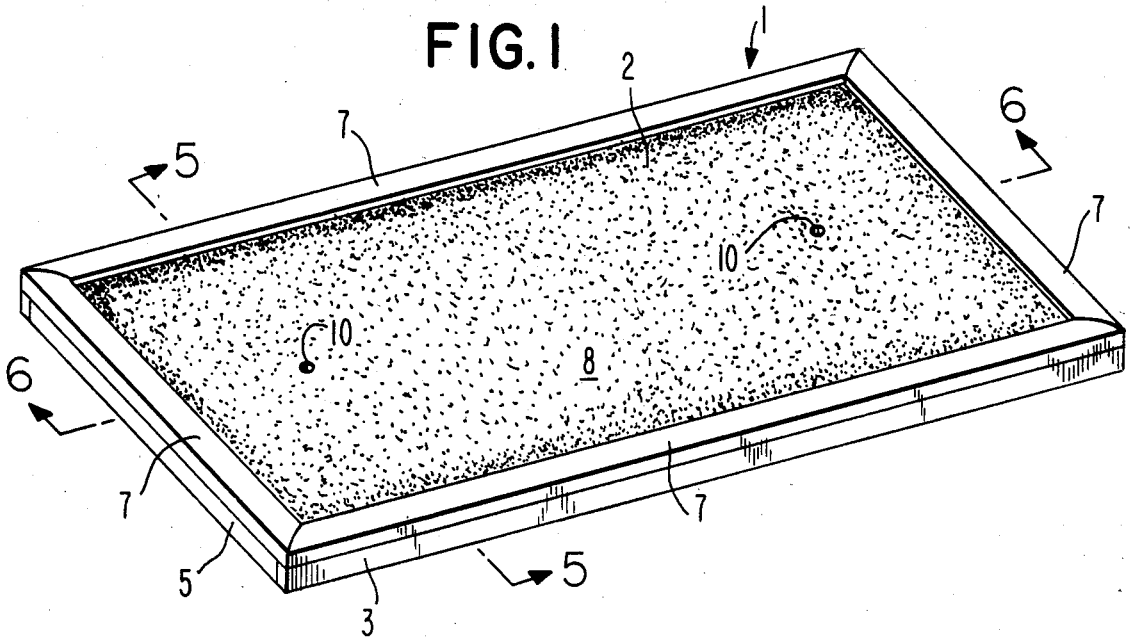
FIG. 1 is a perspective top plan view of a disappearing stairway insulated cover shown in accordance with the present invention.

With reference to the drawings, FIG. 1 depicts a perspective view of an assembled insulating door cover. The door cover generally designated as 1, includes a slab 2, which is preferably of a light, rigid, thermal insulating material, such as styrofoam made from polystyrene by the blow-molding process. The size of the slab should conform to the size of the door to be covered, which generally includes a molding around it.

One of the standard sizes of a disappearing attic stairway is about $59\frac{1}{2}'' \times 31\frac{1}{2}$. The following dimensions are given for the parts in accordance with the above standard-size door. They are easily adapted by one skilled in the art to doors of different sizes.

It is to be understood that the term "lower" referred to herein refers to the orientation of the insulating cover in its installed position.

As shown in FIG. 1, longitudinal side walls 3 and 4, and lateral side walls 5 and 6, about $\frac{3}{4}''$ thick and 2" high, are rigidly connected to each other forming a rectangular frame whose inside dimensions are identical to the outside dimensions of the slab 2, the side walls are preferably made of wood.

Figure 2:
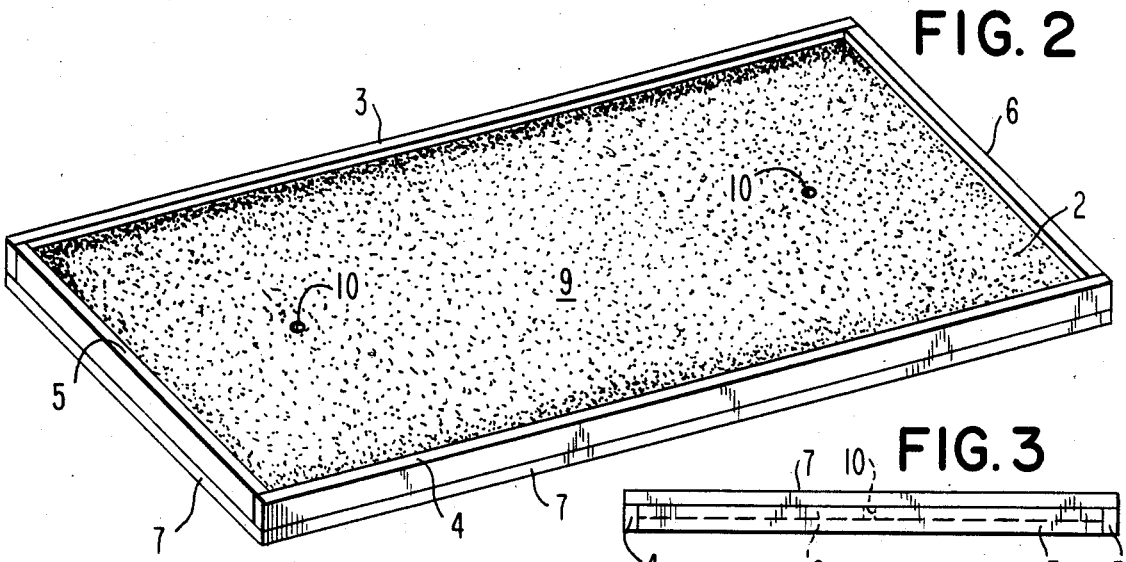
FIG. 2 is a perspective bottom plan view of the embodiment of the invention.
Figure 3:
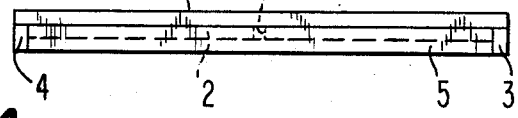
FIG. 3 is an end elevational view of the invention taken from either end.
Figure 4:
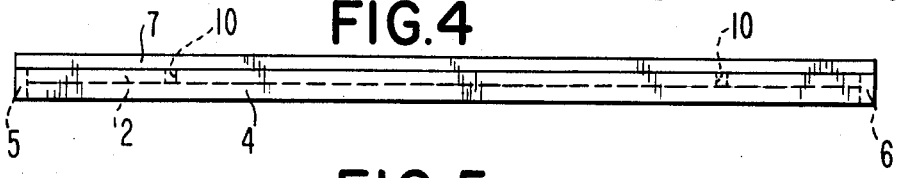
FIG. 4 is a side elevational view of the invention taken from either side.

FIG. 2 illustrates an assembled insulating door cover in the position in which it is to be installed.

Figure 5:
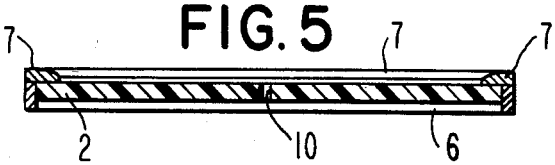
FIG. 5 is a cross-sectional view taken along line 5—5 of FIG. 1.
Figure 6:
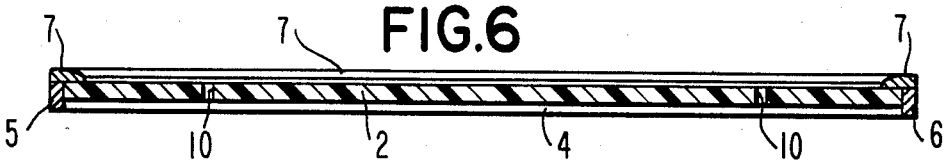
FIG. 6 is a cross-sectional view taken along line 6—6 of FIG. 1.

A set of four wooden molding strips, 7, optionally with mitered corners and beveled faces, about $1\frac{1}{4}''$ wide and $\frac{1}{2}''$ thick at the outer edge, is securely connected to the lower face of the side walls by means of adhesive, finishing nails or both. These molding strips form a lip around the periphery of the frame in a manner such that the slab is adhesively affixed to the lip. The slab is now rigidly confined within the frame and supported by the molding strips 7, as best illustrated in FIGS. 5 and 6. Adhesive is applied to the interface of the slab and the molding strips thereby the frame is attached to the slab by virtue of the affixture of the molding strips to the frame.

In use, the cover provides a recess for accomodating any existing moldings around a trap door. Two screws, 10, spaced at each end of the cover, passing through the slab, are provided for removably attaching said cover to the trap door. Obviously other fasteners may be adapted to attach such cover to a trap door. Thus, the trap door along with its cord or handle, if any, is concealed behind the cover.

It is to be understood that the dimensions of the insulating cover are given with respect to a trap door of a disappearing stairway or folding stairway. This is done for the purpose of illustration, and not to limit the scope of this invention.

It can readily be seen that an insulating cover in accordance with the present invention can easily be made to fit any size of door.

Numerous modifications may be made without departing from the spirit and scope of this invention as set forth in the appended claims.

What I now claim is:

1. An insulating cover adapted to fit over a trap door comprising:

a. A slab of thermal insulating material made of rigid foam of a size sufficiently large to fit over the trap door;

b. A frame having side walls and said side walls having a lower face and the inside dimensions of the frame are of the same size as are the outside dimensions of the slab;

c. Molding means securely connected to the lower face of the side walls forming a lip extending inwardly and around the periphery of the frame whereby the slab is adhesively affixed to the lip; and d. Fastening means for removably attaching said cover to said trap door.

2. An insulating cover of claim 1, wherein the molding means are decorative, beveled and mitered at the corners.

3. An insulating cover of claim 1, wherein fastening means is a pair of screws spaced at each end of the slab.

4. An insulating cover of claim 1, wherein the side walls are no more than 2" in height and $\frac{3}{4}$" in thickness and the molding means are $1\frac{1}{2}$" wide and $\frac{1}{2}$" in thickness.

5. An insulating cover of claim 4, wherein the side walls and the molding means are made of wood, and the slab is regular.

* * * * *